US005398449A

United States Patent [19]

Kobrehel et al.

[11] Patent Number: 5,398,449

[45] Date of Patent: Mar. 21, 1995

[54] WINDOW REGULATOR FOR A FRAMELESS DOOR ASSEMBLY

[75] Inventors: Michael D. Kobrehel, Lexington, Ind.; James F. Trevarrow, Jr., Pickney, both of Mich.

[73] Assignee: Excel Industries, Inc., Elkhart, Ind.

[21] Appl. No.: 274,585

[22] Filed: Jul. 13, 1994

Related U.S. Application Data

[63] Continuation of Ser. No. 37,614, Mar. 3, 1993, abandoned.

[51] Int. Cl.[6] ..... E05F 11/48

[52] U.S. Cl. ..... 49/352

[58] Field of Search ..... 49/347, 348, 350, 352, 49/374, 502

[56] References Cited

U.S. PATENT DOCUMENTS

| | | | |
|---|---|---|---|
| 4,004,371 | 1/1977 | Podolan et al. | 49/352 |
| 4,222,202 | 9/1980 | Pigeon | 49/352 |
| 4,253,277 | 3/1981 | Campbell et al. | 49/352 |
| 4,263,748 | 4/1981 | Kazewych | 49/352 |
| 4,685,248 | 8/1987 | Hammond | 49/352 |
| 4,793,099 | 12/1988 | Friese et al. | 49/352 |
| 4,920,697 | 5/1990 | Vail et al. | 49/352 X |
| 5,035,083 | 7/1991 | Kruzich | 49/352 |

*Primary Examiner*—Jerry Redman

*Attorney, Agent, or Firm*—Allegretti & Witcoff, Ltd.

[57] ABSTRACT

A dual drive window regulator for use with a door assembly for raising and lowering a window glass. The window regulator includes a window glass mounted to two window carriers. The carriers are supported by stationary tracks for shiftable movement thereon. A toothed rack connects each carrier to a movable toothed slide member housed within the tracks. Each carrier overlies the sides of a track to prevent lateral movement of the carrier and window glass during raising and lowering.

6 Claims, 5 Drawing Sheets

WINDOW REGULATOR FOR A FRAMELESS DOOR ASSEMBLY

This application is a continuation of application Ser. No. 08/037,614, filed on Mar. 3, 1993, now abandoned.

This invention relates to a dual drive window regulator, in particular a window regulator for a frameless door assembly.

BACKGROUND OF THE INVENTION

Window regulators that raise and lower windows inside vehicle door assemblies have been in existence since the 1890's. Initially, window regulators used a single drive mechanism, which applied a lifting force at a central contact point on the window glass. The single point lifting force necessitated the use of a guide mechanism to prevent binding as the window glass moved between its raised and lowered positions. Also, door assemblies have included window frames, which house guide channels to support the window glass along the forward and rearward edges. Furthermore, such door assemblies often carried guides to support the window glass inside the door assemblies.

U.S. Pat. No. 4,920,697 granted on May 1, 1990 to Vail et al. and incorporated herein by reference discloses the use of a dual drive window regulator. Such a dual drive window regulator uses a two point window contact, which eliminates the binding conditions of the single drive mechanism. However, the window regulator in Vail '697 is still dependent upon a guide mechanism to support the window glass in its raised position. Frameless door assemblies lack a window frame which supports a portion of the window glass guide mechanisms. Vehicles with frameless door assemblies, such as convertibles, have no structure above the belt line. Consequently, the stability provided by the guide channels of the window frame is lost in frameless door assemblies.

SUMMARY OF THE INVENTION

The dual drive window regulator of this invention provides more stable structure with only the need of a minimal guide mechanism. Consequently, the dual drive regulator of this invention is ideal for use in frameless door assembles and, in many applications, can eliminate the need for window frames on door assemblies and extensive guide mechanisms.

In this invention, the window regulator includes the conventional dual guide tracks and a motor drive that drives toothed slide members within the tracks. The window glass is mounted at spaced locations to a pair of window carriers. The carriers ride along the vertical runs of the two guide tracks and are fixed to the slide members housed inside the tracks. Each carrier is connected to a slide member by a connected rack, which interlocks with the slide member. The racks are restrictively carried within the tracks to prevent the carriers from becoming disengaged from the slide members and tracks. The fit of the carriers about the tracks restricts any lateral movement of the carriers with respect to the tracks. Consequently, the window glass is firmly held in both the raised and lowered positions by the structural integrity of the tracks.

Accordingly, an object of this invention is to provide for dual drive window regulator for use with a frameless door assembly.

Another object is to provide for a dual drive window regulator that reduces the use of window guides, thereby reducing the size and number of components in the door assembly and decreasing both the cost and weight of the door assembly.

Other objects of this invention will become apparent upon a reading of the following description and drawings.

BRIEF DESCRIPTION OF THE DRAWINGS

A preferred embodiment of the invention has been depicted for illustrative purposes only wherein.

DESCRIPTION OF THE PREFERRED EMBODIMENT

The preferred embodiment herein described is not intended to be exhaustive or to limit the invention to the precise form disclosed herein. It is chosen and described to explain the principles of the invention and its application and practical use to enable others skilled in the art to utilize its teachings.

Figure 1:
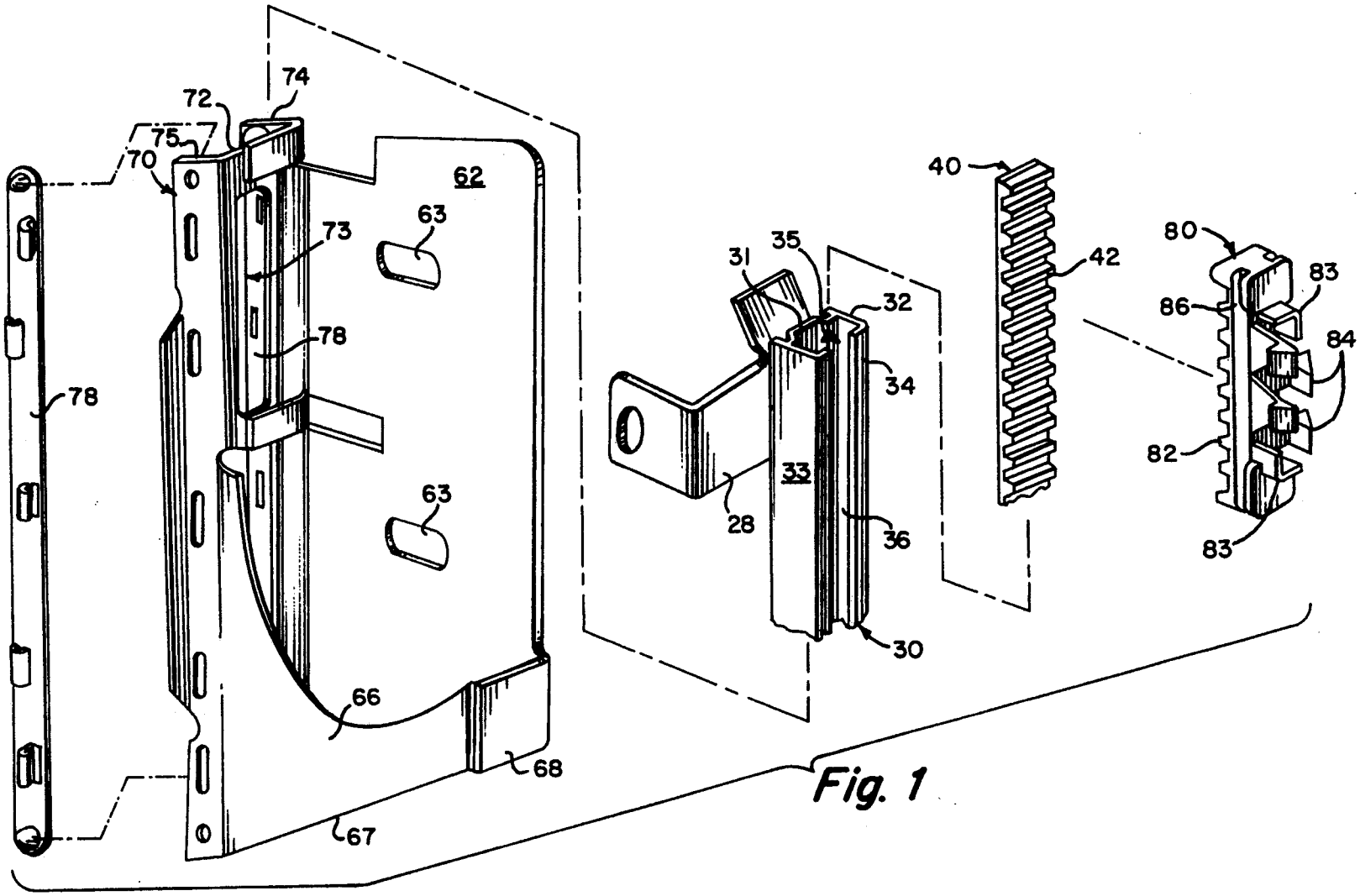
FIG. 1 is an exploded view of a carrier, rack, slide member and track of this invention shown in part in fragmentary form.
Figure 3:
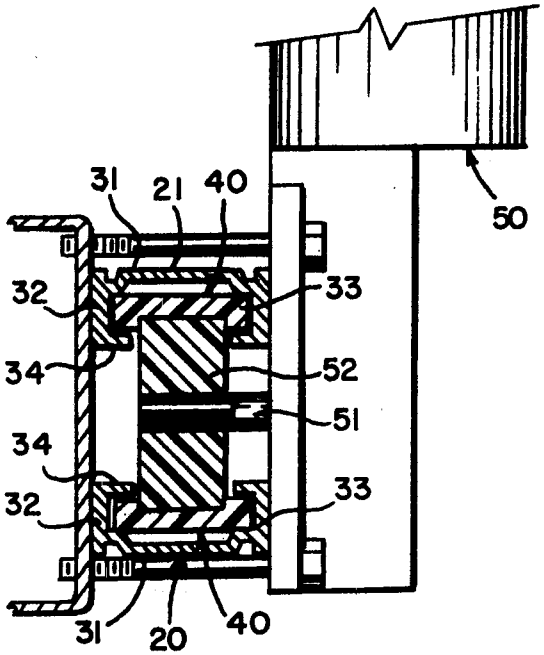
FIG. 3 is a sectional view of the drive mechanism taken along line 3—3 of FIG. 4.
Figure 2:
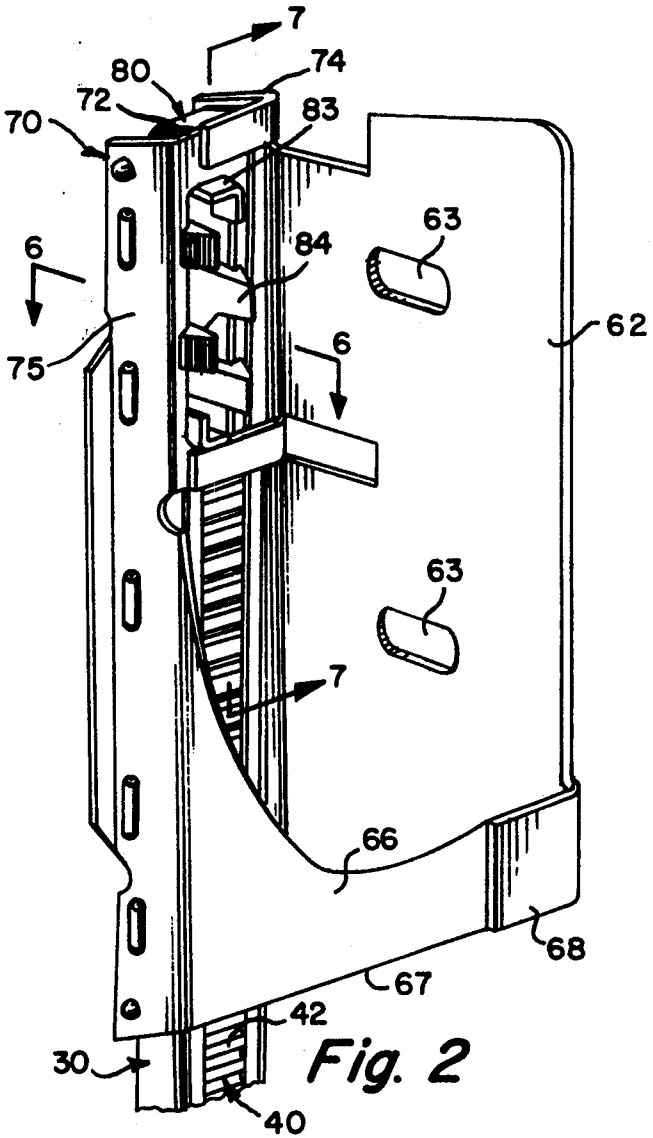
FIG. 2 is a perspective view of a carrier of this invention mounted to a track.
Figure 4:
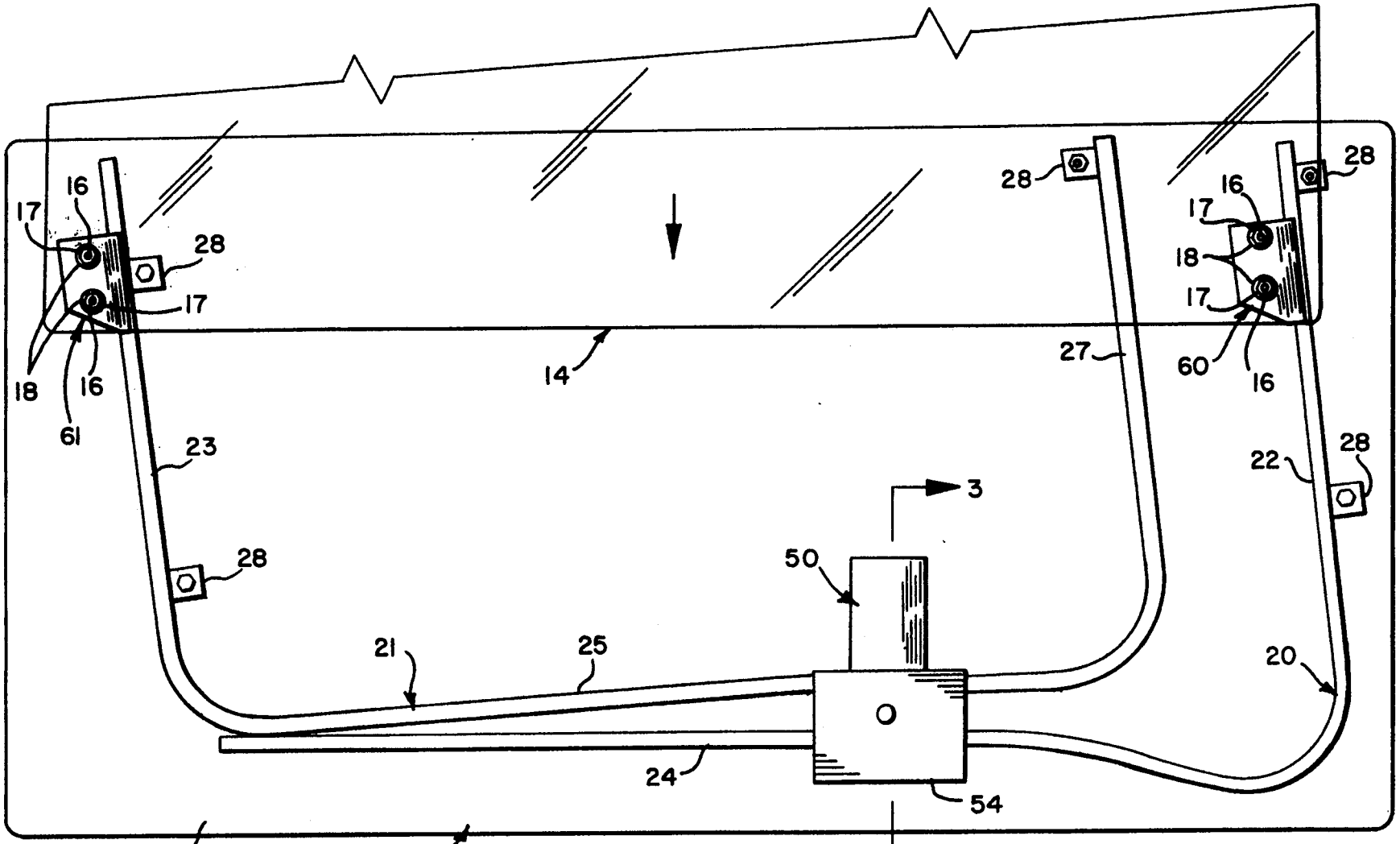
FIG. 4 is perspective view of the dual drive window regulator with the window glass in the raised position.
Figure 5:
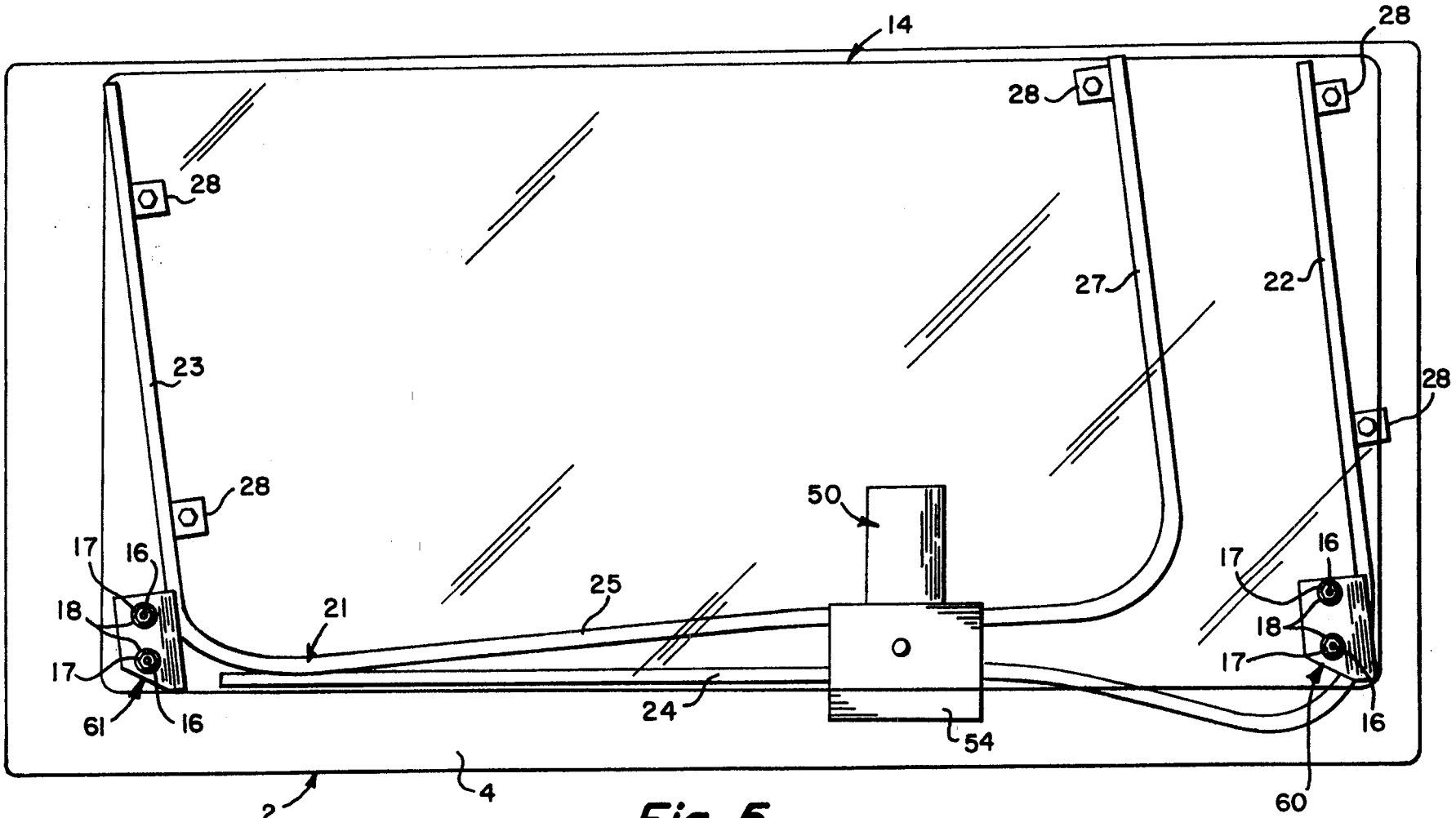
FIG. 5 is perspective view of the dual drive window regulator with the window glass in the lowered position.

FIGS. 4 and 5 show the dual drive window regulator assembly 10 of this invention used in a frameless door assembly 2 of a passenger vehicle (not shown). The detailed construction of standard door assembly 2 is disclosed in U.S. Pat. No. 4,920,697, which has been incorporated herein by reference. Regulator assembly 10 of this invention, while shown with a frameless door assembly, can be used with any conventional framed door assembly and is not limited to any particular design or model.

Regulator assembly 10 is mounted within the interior cavity of the door assembly 2 and includes a pair of stationary tracks 20, 21. Each tracks 20, 21 includes an elongated hollow channel 30 with a generally rectangular cross section. Channel 30 has an interior 35 formed by a bottom wall 31 and two spaced side walls 32, 33. Side walls 32, 33 terminate in inturned spaced lips 34 that define a continuous slot 36 along the length of each track 20, 21. Tracks 20, 21 are mounted within the door assembly by brackets 28. Each bracket 28 is connected between a track 20, 21 and a frame part 4 of door assembly 2.

Track 20 includes a vertical run 22 that curves into a horizontal run 24 at the bottom of door assembly 2. Vertical run 22 extends along one end of door assembly 2 and horizontal run 24 extends along the bottom of door assembly 2. Track 21 includes a vertical run 23 that curves into a horizontal run 25 and ends in another vertical run 27. Vertical run 23 of track 21 extends along the opposite end of door assembly 2, and horizontal run 25 extends along the bottom of door assembly 6 spaced above horizontal run 24 of track 20. Slots 36 in horizontal runs 24, 25 of tracks 20, 21 face one another.

Each track 20, 21 supports an elongated slide member 40. Each slide member 40 is flexible and has a generally rectangular cross sectional configuration. One side of each slide member 40 is formed with teeth 42 that face slot 36 in the supporting tracks.

As shown in FIGS. 4 and 5, horizontal runs 24, 25 of tracks 20, 21 are positioned to allow a drive pinion 52 to engage teeth 42 of each slide members 40 through adjacently facing slots 36 in the tracks. Pinion 52 is driven by the output shaft 51 of an electric motor 50. Motor 50 is bolted to a mounting plate 54 that is secured to the frame part 4 of door assembly 2. It is also to be understood that a manually operated window crack (not shown) can also be used to rotate pinion 52. Rotation of drive pinion 52 moves slide members 40 inside tracks 20, 21 in opposite directions in common rack and pinion fashion.

Each vertical run 22, 23 supports a window carrier 60, 61 respectively. Each carrier 60, 61 includes a window support plate 62 and an integral U-shaped side channel 70 located along one edge of window plate 62. Side channel 70 includes a carrier back wall 72 and two spaced elongated carrier side walls 74, 75. Carrier side walls 74, 75 extend beyond the lower end of carrier back wall 72 of side channel 70. Carrier side wall 74 forms a part of window plate 62. Carrier back wall 72 has an elongated opening 73. Window plate 62 has an angled lower edge 64 and two glass mounting holes 63. Carrier side wall 75 includes an extension part 66 located below carrier back wall 72, which parallels window plate 62. Extension part 66 and window plate 62 are joined at 68. Support member 66 also has a angled lower edge 67.

As shown in FIGS. 2 and 4–7, each carrier 60, 61 rides on a vertical run 22, 23 of a track 20, 21 with the track fitting between carrier side walls 74, 75. An elongated runner 78 is secured to the inner faces of each carrier side wall 74, 75 and is located restrictively between the carrier side wall and the adjacent track side wall. Runners 78 are constructed of a minimal friction creating material, such as Acetal. Runners 78 provide a smooth durable surface engagement between side walls 74, 75 and track walls 32, 33 for each of movement of carrier 60, 61 along its engaging track 20, 21.

A rack 80 having teeth 82 is secured by interlocking fingers 84 to back wall 72 of each carrier 60, 61. Each rack 80 includes shoulders 83 that, with latch fingers 84, extend through opening 73 in each carrier back wall 72. Shoulders 83 prevent rack 80 from shifting laterally relative to the carrier within opening 73, and latch fingers 84 prevent the rack from pulling out of the opening. Teeth 82 mesh with teeth 42 of the adjacent slide member 40. Each rack 80 includes at its side edges grooves 86, which accept the inturned lips 34 of the carrier engaging track 20, 21.

Figure 6:
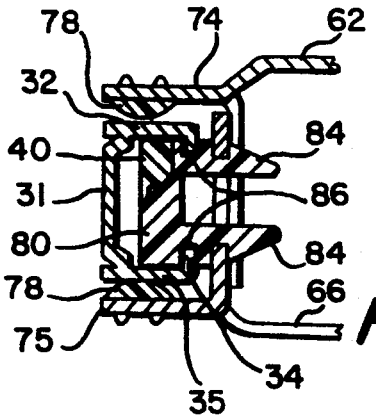
FIG. 6 is a sectional view of a carrier mounted to a track taken along line 6—6 of FIG. 2.
Figure 7:
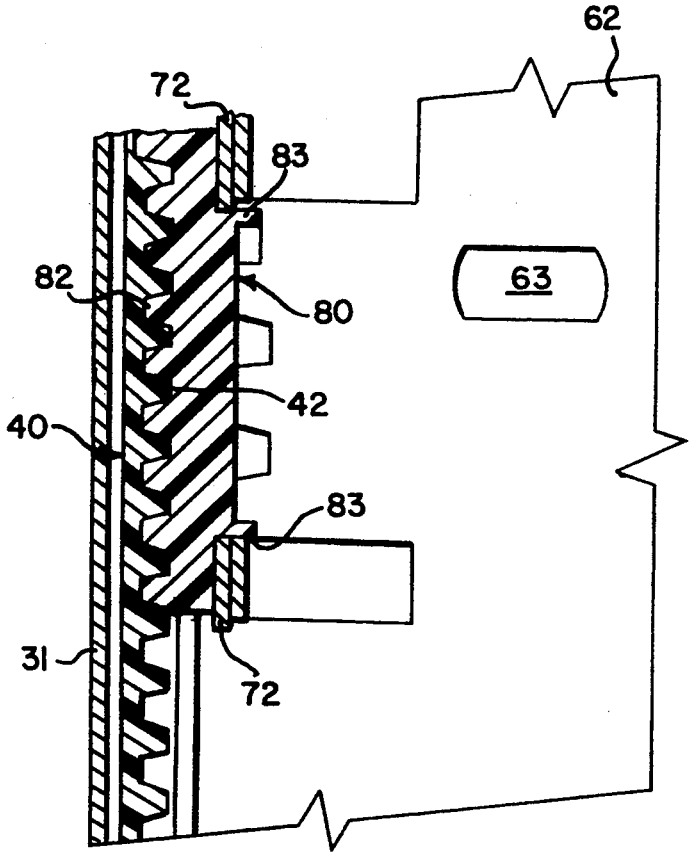
FIG. 7 is a sectional view of a carrier mounted to a track taken along line 7—7 of FIG. 2.

Racks 80 connect carriers 60, 61 to their respective slide members 40, so that the carriers will move along tracks 20, 21 as the slide members 40 are moved within the tracks by motor 50. Each rack 80 engages the upper end of slide member 40 with teeth 82 and 42 interlocking. As shown in FIG. 6, grooves 86 in each rack 80 accepts lips 34 of the carrier engaging track 20, 21, which compresses the intermediate slide member 40 between the rack and track and prevents the carrier from becoming disengaged from the slide member. The engagement of track lips 34 and rack grooves 90 also helps to prevent the carrier from pulling away from the track. With racks 80 engaged with slide members 40, rotation of drive pinion 52 drives the slide members in opposite directions to move carriers 60, 61 along vertical runs 22, 23 of the track.

As shown in FIGS. 4 and 5, a window glass 14 is mounted to carriers 60, 61. Mounting studs 16 extend through mounting holes (not shown) in window glass 14 and mounting holes 63 in carriers 60, 61. A fastener 17 is threaded onto studs 16 to secure the window glass to carriers 60, 61. Elastomer gaskets or washers 18 can be employed to prevent damage to the window glass 14. With window glass 14 mounted to carriers 60, 61, the glass is firmly supported at all times by structural integrity of tracks 20, 21, which are secured to frame part 4 of door assembly 2. Any side to side movement is prevent by the engagement of the carrier side walls with the track side walls. Any forward and aft movement is restricted by the positioning of track lips 34 within rack grooves 86. Since window glass 14 is firmly held to carriers 60, 61 and supported by the structural integrity of tracks 20, 21, regulator assembly 10 eliminates the need for any window exterior guide assemblies.

It is understood that the above description does not limit the invention to the details given, but may be modified within the scope of the following claims.

I claim:

1. A window regulator used in a door assembly for raising and lowering a window glass between a raised position in which the window glass is extended from the door assembly and a lowered position in which the window glass is stored within the door assembly, the window regulator comprising:

a pair of elongated tracks mounted to the door assembly, each track including a vertical run portion and having two spaced side walls connected by a back wall to define a longitudinal slot extending substantially the length of the track, the side walls terminating opposite the back wall in opposed inturned lips;

a pair of elongated slide members each disposed within the slot of a corresponding one of the tracks for longitudinal sliding therein;

drive means for driving back-and-forth longitudinal sliding of the slide members in the slots of the tracks;

a pair of securement members, each mounted to a corresponding one of the tracks for longitudinal sliding thereon, having a front surface disposed within the slot in locking engagement with the slide member, side surfaces forming longitudinal grooves slidingly receiving the inturned lips of the track side walls, and a back surface disposed outside the slot;

a pair of carrier members, each mounted to a corresponding one of the tracks for longitudinal sliding thereon in locking engagement with the securement member while supporting the window glass, having a carrier front wall overlying the slot, opposed carrier side walls extending from opposite sides of the carrier front wall to overlie a corresponding one of the track side walls in sliding contact therewith, and a carrying wall providing longitudinally extended support of the window glass.

2. The window regulator of claim 1 wherein the longitudinally extended support of the window glass provided by the longitudinally extended carrying wall of each carrier member comprises attachments to longitudinally spaced support holes in the carrying wall.

3. The window regulator of claim 1 wherein each carrier side wall is longitudinally elongated and includes a plastic, longitudinally elongated runner part in sliding contact with the track side wall.

4. The window regulator of claim 1 wherein each securement members connected at its said back wall ti its carrier member.

5. The window regulator of claim 1 wherein each slide member includes slide teeth directed toward the track slot of its associated track, each securement member including teeth meshing with the slide teeth of its engaging slide.

6. The window regulator of claim 5 wherein said slide teeth extend the length of the slide, said drive means including a gear in driving engagement with said slide teeth.

* * * * *